US005720408A

United States Patent [19]

Schmid et al.

[11] Patent Number: 5,720,408

[45] Date of Patent: Feb. 24, 1998

[54] SEALING CAP FOR CANS OF VARIOUS DIAMETERS PROVIDED WITH AN EDGE BEADING

[76] Inventors: Dieter Schmid, Radaustrasse 23, D-86199 Augsburg; Oliver Schmid, An der Steig 5, D-86482 Aystetten, both of Germany

[21] Appl. No.: 581,542

[22] PCT Filed: Oct. 12, 1994

[86] PCT No.: PCT/EP94/03352

§ 371 Date: Jan. 4, 1996

§ 102(e) Date: Jan. 4, 1996

[87] PCT Pub. No.: WO95/11835

PCT Pub. Date: May 4, 1995

[30] Foreign Application Priority Data

Oct. 25, 1993 [DE] Germany ..... 9316245 U

[51] Int. Cl.[6] ..... B65D 21/00

[52] U.S. Cl. ..... 220/287; 215/319; 220/717; 220/718; 222/570

[58] Field of Search ..... 222/570; 220/717, 220/718, 287; 215/319

[56] References Cited

U.S. PATENT DOCUMENTS

| | | | |
|---|---|---|---|
| 4,387,826 | 6/1983 | Heubl | 222/570 X |
| 4,511,057 | 4/1985 | Tontarelli | 220/793 X |
| 4,579,257 | 4/1986 | Brandlein | 222/570 X |
| 5,062,552 | 11/1991 | Heubel | 220/287 X |

FOREIGN PATENT DOCUMENTS

| | | |
|---|---|---|
| 0 112 306 A3 | 12/1983 | European Pat. Off. . |
| 31 04 604 A1 | 12/1982 | Germany . |
| 33 41 237 A1 | 5/1985 | Germany . |
| 34 25 920 A1 | 1/1986 | Germany . |

*Primary Examiner*—Allan N. Shoap
*Assistant Examiner*—Robin A. Hylton
*Attorney, Agent, or Firm*—McGlew and Tuttle

[57] ABSTRACT

A closure for cans or tins of different diameters having an edge bead. A spring component with a loop-like protrusion is guided in a radial slide guide on the underside of a plate-like basic component of the closure. The loop-shaped web facing the tin merges into the face edge web which thus elastically grips beneath the edge bead of the tin. The loop-shaped web facing away from the tin is supported on the basic component and thus provides the spring loading.

8 Claims, 1 Drawing Sheet

SEALING CAP FOR CANS OF VARIOUS DIAMETERS PROVIDED WITH AN EDGE BEADING

FIELD OF THE INVENTION

The present invention pertains to a sealing cap for cans of various diameters provided with an edge beading, whose lid contains a tear tab for forming a pouring opening, comprising a plate-shaped basic body made of plastic, which spans over the lid and extends under the edge beading with at least one oppositely arranged, elastic front edge web in a snap closure-like manner, wherein the elastic front edge web is radially displaceable in a sliding guide of the basic body, and wherein a ring seal surrounding the pouring opening of the lid can be clamped between the basic body and the lid.

BACKGROUND OF THE INVENTION

Sealing caps of this class have been known from DE-OS 34 25 920. A sliding guide, in which a complicated plastic sliding piece is movable, is located on the underside of a plate-shaped basic body extending over the can. A compression spring, which has the task of pressing the sliding element against the edge of the can, is clamped between the sliding piece and an edge area of the basic body. The sliding piece has two elastic legs, at whose ends facing the can a lug extending under the edge beading of the can is provided. To make it possible to detach the sealing cap from the can, the elastic legs must be pressed inward against each other to enable the lugs to become detached from the edge beading. Such an arrangement is complicated in terms of manufacturing technology, its assembly is complicated, and it is expensive, aside from the fact that the basic body can be guided only insufficiently in the basic body, and the compression spring is particularly susceptible to the deposition of contamination.

SUMMARY AND OBJECTS OF THE INVENTION

The basic object of the present invention is therefore to substantially simplify the above-mentioned prior-art sealing cap in terms of the design of the elastic front edge web, to make it less expensive, and to avoid the above-mentioned disadvantages.

Based on DE-OS 34 25 920, this object is accomplished according to the present invention by the elastic front edge web being designed as an intrinsically elastic spring element having a loop-shaped bulge, one loop web of which spring element is supported on the basic body and whose other loop web passes over into a gripping element with the elastic front edge web located thereon.

The advantages of this arrangement are that the spring element can be designed in one piece and that it generates a sufficiently strong intrinsic spring force as a consequence of the loop-shaped bulge, and therefore it can be manufactured at a low cost and can be assembled in a particularly simple manner. Better guiding can also be achieved on the underside of the basic body as a consequence of this design of the spring element.

Advantageous embodiments of the sealing cap according to the present invention are disclosed. The spring element preferably consists essentially of a rectangular cross section. A special design of the gripping element is also described. This gripping element is of particular significance for the attachment of the sealing cap to cans of various diameters and for the detachment of the sealing cap from the can, because when the gripping element is designed as a wedge-shaped thickening, it forms an oblique slide-up surface, which causes a displacement of the spring element against the spring force and the spring element to snap in during the attachment of the sealing cap to a can edge. On the other hand, this wedge-shaped thickening of the gripping element offers the possibility of retracting the spring element when the sealing cap is to be detached from the can, because the wedge-shaped thickening forms an acceptable surface for the finger to act upon.

The embodiment according to which the loop-like bulge extends at right angles to the plane of the plate-shaped basic body, is recommended to ensure that the spring element according to the present invention can exert a sufficient spring action. This means that the bulge comes to lie under the basic body. Therefore, it does not interfere with the handling of the can.

A design of the sealing cap according to the invention has the advantage that the spring element can be pushed into the sliding guide of the basic body in the radial direction from the front side. The sliding surface is substantially larger than in the state of the art, so that the spring element is sufficiently guided in each position of the spring. Therefore, only the mounting operation in which the loop web facing away from the elastic front edge web is allowed to snap into a depression of the basic body is necessary, which naturally requires a certain deformation of the spring element. This snapping in may be performed manually without a tool, whereas the removal of the spring element from the snapped-in position is preferably performed by means of a tool, which consists essentially of compressing the loop-shaped bulge.

Due to this design, the clamped-in spring element is guided in an absolutely safe manner in terms of transportation, and it cannot lead to injury. Its displacement into the detached position of the elastic front edge web is possible in a particularly simple manner by depressing either the loop-shaped bulge or displacing the spring element at the wedge-shaped thickening with a finger.

Contrary to the state of the art, the spring element according to the present invention has the elastic front edge web itself, without the latter needing to be specially actuated. It is pointed out for the sake of clarity that the front edge web does not need to be elastic in itself, but it has an elastic action as a consequence of the elastic design of the spring element. This elastic front edge web has a concave curvature, which is part of the spring element.

A special design of the spring element, intended to guarantee its guiding, on the one hand, and its elasticity, on the other hand, is also described.

An especially inexpensive manufacture of the spring element is guaranteed according to further feature of the invention by the spring element being made of a plastic possessing elastic and resilient properties. Especially colored or uncolored polyoxymethylene has proved to be advantageous as such a plastic. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
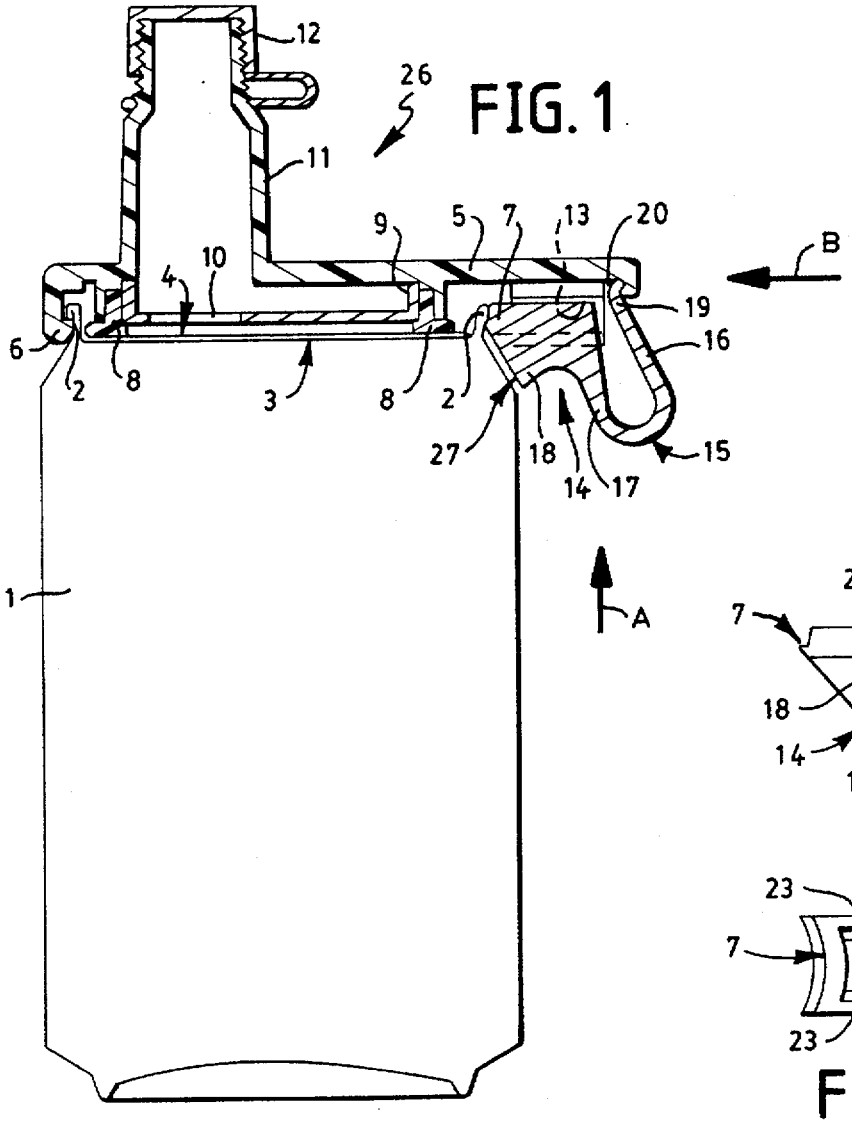
FIG. 1 is a side view of a can with a sealing cap, which is placed on it and is shown as a sectional view.

The exemplary embodiment according to FIG. 1 shows a side view of a can 1, which has a circumferential edge beading 2 and a lid 3 on the opening side. A pouring opening 4, which is formed by a tear tab, not shown, is located in the lid 3. Reference number 26 designates a sealing cap, shown as a sectional view, which must be suitable for effectively sealing cans of various diameters when the tear tab is detached and the pouring opening 4 is open.

The sealing cap 26 has a plate-shaped basic body 5, especially one made of a plastic, which extends over the can. This basic body 5 has a stationary front edge web 6 on one side and an elastic front edge web 7 on the other side, and these front edge webs extend under the edge beading 2 of the can 1. To guarantee sufficient sealing, a ring seal 8, which is pressed against the lid 3 when the basic body 5 is placed on the can and surrounds the pouring opening 4 of the can, is located between the basic body 5 and the can lid 3. This ring seal 8 is supported on the inside by an insertable cap 9, which has a passage opening 10 that is congruent with the pouring opening 4. The sealing cap 26 may have a pouring spout, but this is not absolutely necessary. In the example according to FIG. 1, the pouring spout 11 is provided with a closing cap 12 which can be attached via a threaded part. If this pouring spout 11 is not to be provided, the basic body 5 has a continuous plate-shaped design.

The elastic front edge web 7 is part of a spring element 14, which is displaceable in a radial sliding guide 13 on the underside of the plate-shaped basic body 5.

Figure 4:
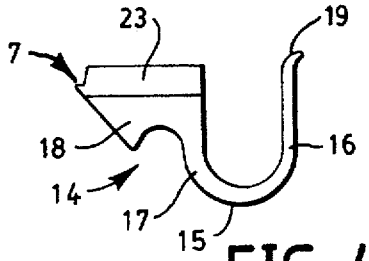
FIG. 4 is a side view of the spring element according to the present invention.
Figure 5:
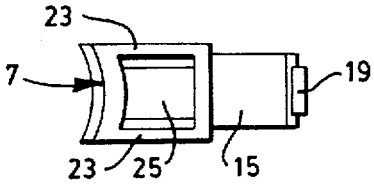
FIG. 5 is a top view of the spring element according to FIG. 4.

As is shown in detail especially in FIGS. 4 and 5, the spring element 14 has a loop-shaped bulge 15, by which the two loop webs 16, 17 are formed. The loop web 16 is intended to snap with one edge 19 into a depression 20 of the plate-shaped basic body 5 and thus to generate the supporting force for the spring action of the spring element 14. The loop web 17 has a gripping element 18 and the front edge web 7 located thereon. This front edge web 7 is not elastic itself. Its spring action is due, instead, to the elastic property of the spring element 14.

The gripping element 18 has a wedge-shaped thickening, which has a dual function. On the one hand, one flank 27 is used to cause the spring element 14 to be pushed back when the sealing cap 26 is placed on a can 1, because the edge beading 2 comes into contact with this flank 27. As soon as the front edge web 7 has snapped in under the edge beading 2, the flank 27 or the loop-shaped bulge 15 is used to push the spring element 14 manually back against the spring force and to detach the sealing cap 26 from the can 1.

Figure 3:
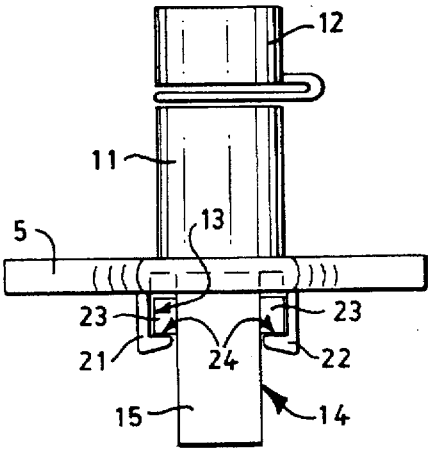
FIG. 3 is a front view of the sealing cap according to arrow B in FIG. 1.
Figure 2:
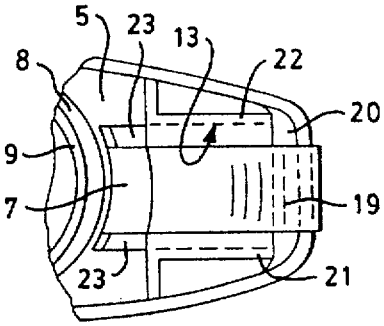
FIG. 2 is a bottom view of the sealing cap according to arrow A in FIG. 1.

The examples according to FIGS. 2 and 3 show details of the design of the plate-shaped basic body 5 for forming the sliding guide 13. The sliding guide 13 is formed by two legs 21, 22, which have an undercut groove 24 (see FIG. 3), into which guide bars 23 of the spring element 14 extend. These undercut grooves 24 are open radially to the outside, so that the spring element 14 with its guide bars 23 can be pushed very simply radially into the sliding guide 13 from the outside. Only the loop web 16 (see FIG. 1) needs to be pushed in to the inside and to be allowed to snap into the depression 20. The loop web 16 therefore has a greater length than the loop web 17, so that the edge 19 of the loop web 16 cap find a secure anchoring at the plate-shaped basic body 5.

The undercut grooves 24 are formed by bent legs 21, 22, which are arranged on the underside of the plate-shaped basic body 5. A sufficiently large space is located between these legs 21, 22 to allow the loop-shaped bulge 15 of the spring element 14 to pass through.

The example according to FIG. 5 also shows that the area of the spring element 14 which is surrounded by the guide bars 23 and by the concavely curved front edge web 7 has a hollow space 25, which makes it possible to save material and also contributes to the increase in the spring force.

While specific embodiments of the invention have been shown and described in detail to illustrate the application of the principles of the invention, it will be understood that the invention may be embodied otherwise without departing from such principles.

LIST OF REFERENCE NUMBERS

1 Can
2 Edge beading
3 Lid
4 Pouring opening
5 Plate-shaped basic body
6 Stationary front edge web
7 Elastic front edge web
8 Ring seal
9 Cap
10 Passage opening
11 Pouring spout
12 Closing cap
13 Sliding guide
14 Spring element
15 Loop-shaped bulge
16 Loop web
17 Loop web
18 Gripping element
19 Edge
20 Depression
21 Leg
22 Leg
23 Guide bar
24 Undercut groove
25 Hollow space
26 Sealing cap
27 Flank

We claim:

1. A sealing cap for cans of various diameters, the can having an edge beading and having a lid with a tear tab to form a pouring opening, the sealing cap comprising: a plate-shaped basic body formed of plastic, said basic body spanning over said lid and extending under said edge beading and including at least one elastic front edge web defining a snap mechanism arranged oppositely where said lid extends under said edge beading, said basic body including a sliding guide, said elastic front edge web being radially displaceable in said sliding guide of said basic body; a ring seal surrounding said pouring opening of said lid, said ring seal being clamped between said basic body and said lid, said elastic front edge web including an intrinsically elastic spring element for biasing said elastic front edge web toward the can, said elastic spring element providing for adaptation to cans of various diameters, said spring element including a loop-shaped bulge including a first loop web supported on said basic body, said loop-shaped bulge further including another loop web and a gripping element, said another loop web connecting said loop web to said gripping element.

2. A sealing cap according to claim 1, wherein said spring element is made in one piece, the one piece having an essentially rectangular cross section.

3. A sealing cap according to claim 1, wherein said gripping element includes a wedge shaped thickening of an area of said spring element located between said elastic front edge web and said another loop web, said wedge-shaped thickening defining a manually operable portion.

4. A sealing cap according to claim 1, wherein said loop-shaped bulge of said spring element extends at a right angle to a plane of said plate-shaped basic body.

5. A sealing cap according to claim 1, wherein said basic body has an underside with a radially extending open undercut guide, said undercut guide for receiving said spring element wherein said spring element can be pushed from an outside and wherein said first loop web facing away from said elastic front edge web is supported with an edge extending beyond said guide in a depression of said basic body.

6. A sealing cap according to claim 1, wherein said elastic front edge web is curved concavely toward the can.

7. A sealing cap according to claim 1, wherein said spring element includes laterally projecting guide bars, said sliding guide including legs, said guide bars extending into undercut grooves of said legs, said loop-shaped bulge of said spring element extending downwardly through a space left between said legs.

8. A sealing cap according to claim 1, wherein said spring element is made in one piece of a plastic, said plastic having elastic and resilient properties.

* * * * *